US005317127A

United States Patent [19]

Brewster, Jr. et al.

[11] Patent Number: 5,317,127

[45] Date of Patent: May 31, 1994

[54] APPARATUS INCLUDING AIR BLOWING AND INFRARED LIGHT MEANS FOR DRYING INK ON A SHEET

[75] Inventors: William H. Brewster, Jr., Fairfield; Lun Chan, New Fairfield; Paul R. Sette, Branford, all of Conn.

[73] Assignee: Pitney Bowes Inc., Stamford, Conn.

[21] Appl. No.: 937,640

[22] Filed: Aug. 28, 1992

[51] Int. Cl.[5] ..... F27B 9/06

[52] U.S. Cl. ..... 219/388; 34/273; 34/611

[58] Field of Search ..... 219/388; 34/41, 1 J, 34/1 W, 148, 201; 101/424.1, 488

[56] References Cited

U.S. PATENT DOCUMENTS

| | | | |
|---|---|---|---|
| 3,492,458 | 1/1972 | White et al. . | |
| 3,772,497 | 11/1973 | Gray et al. . | |
| 4,102,681 | 7/1978 | Draugelis et al. . | |
| 4,257,172 | 3/1981 | Townsend | 34/39 |
| 4,434,562 | 3/1984 | Bubley et al. | 34/41 |
| 4,449,453 | 5/1984 | Staffer et al. | 34/41 |
| 4,745,432 | 5/1988 | Langdon . | |
| 4,809,608 | 3/1989 | Wolnick et al. | 34/41 |
| 4,972,255 | 11/1990 | Matsumoto et al. . | |
| 4,994,642 | 2/1991 | Matsumoto et al. | 219/388 |
| 5,092,059 | 3/1992 | Wimberger et al. | 34/41 |
| 5,132,519 | 7/1992 | Jackson et al. | 219/388 |
| 5,159,763 | 11/1992 | Platsch | 34/41 |
| 5,168,811 | 12/1992 | Cox et al. | 101/424.1 |
| 5,216,820 | 6/1993 | Green et al. | 34/41 |

*Primary Examiner*—Bruce A. Reynolds
*Assistant Examiner*—John A. Jeffery
*Attorney, Agent, or Firm*—Donald P. Walker; Melvin J. Scolnick

[57] ABSTRACT

Apparatus for drying ink on a sheet fed downstream therebeneath in a predetermined path of travel, the apparatus comprising; framework, structure for blowing air downwardly toward the path of travel of a sheet, the air blowing structure including an electrically operable axial fan connected to the framework, an elongate member connected to the framework for location thereof beneath the fan, the member including an elongate upper wall and elongate oppositely disposed side walls depending from the upper wall, the upper wall having a light reflecting inner surface, structure for providing infrared light, the light providing structure including an elongate electrically-operable infrared lamp connected to the framework for location thereof within the member, and the upper wall of the member including a plurality of elongate parallel-spaced louvers formed therefrom and extending transversely of the longitudinal length thereof, each of the louvers including an aperture and vane associated with each other, each of the apertures having a generally rectangularly-shaped perimeter edge, each of the vanes being generally rectangularly-shaped and laterally-extending downwardly and downstream relative to the path of travel from the associated perimeter edge, whereby air from the fan is directed by each vane at an angle extending in the direction of the path of travel.

25 Claims, 3 Drawing Sheets

APPARATUS INCLUDING AIR BLOWING AND INFRARED LIGHT MEANS FOR DRYING INK ON A SHEET

BACKGROUND OF THE INVENTION

The present invention is generally concerned with apparatus for drying ink on a sheet and, more particularly, improvements therein including a louvered infrared light reflecting member.

As shown in the following listed U.S. Patents, it is well known in the art to provide structures for drying and fusing ink markings on sheets. In this connection reference is made to U.S. Pat. Nos.: 3,492,458 issued Jan. 27, 1970 to W. E. White et. al. for a THERMOFUSING DEVICE; 3,772,497 issued Nov. 13, 1973 to Gray et. al. for a FUSER FOR ELECTROSTATIC IMAGE; 4,102,681 issued Jul. 25, 1978 to Draugelis, et. al. for a TRANSFER AND FUSING METHOD; 4,745,432 issued May 17, 1988 to Langdon for a LIQUID INK FUSING SYSTEM; 4,972,225 issued Nov. 20, 1990 to Matsumoto et. al. for a SHEET HEATING DEVICE; and 4,994,642 issued Feb. 19, 1991 to Matsumoto et. al. for A SHEET HEATING DEVICE.

Of the foregoing listed patents the most notable, relevant to the present invention is U.S. Pat. No. 4,994,642, issued to Matsumoto, et. al., which discloses and claims a sheet heating device for heating a sheet while the sheet is being fed, wherein the device generally includes a feed path along which the sheet is fed, a heater unit spaced from the sheet feed path, and a slotted screen protective member located between the sheet fed path and the heating unit. More particularly, the sheet protective member has a plurality of holes defined therein for passing heated air from the heater unit toward the sheet feed path at an angle inclined to the sheet feed path.

Notwithstanding the foregoing Patents, and in particular the structures disclosed therein, Applicants' have found that such structures, to the extent that they are suitable for rapidly drying ink on a moving sheet, are both expensive to construct or purchase and costly to maintain. Accordingly:

an object of the invention is to provide improved apparatus for drying ink carried by a sheet;

another object is to provide apparatus for drying ink on a sheet fed downstream therebeneath; and another object is to provide apparatus for drying ink on a sheet fed in a predetermined path of travel between ink jet printing structure and sheet stacking structure.

SUMMARY OF THE INVENTION

Apparatus for drying ink on a sheet fed downstream therebeneath in a predetermined path of travel, the apparatus comprising: framework, means for blowing air downwardly toward the path of travel of a sheet, the air blowing means including an electrically operable axial fan connected to the framework, an elongate member connected to the framework for location thereof beneath the fan, the member including an elongate upper wall and elongate oppositely disposed side walls depending from the upper wall, the upper wall having a light reflecting inner surface, means for providing infrared light, the light providing means including an elongate electrically-operable infrared lamp connected to the framework for location thereof within the member, and the upper wall of the member including a plurality of elongate parallel-spaced louvers formed therefrom and extending transversely of the longitudinal length thereof, each of the louvers including an aperture and vane associated with each other, each of the apertures having a generally rectangularly-shaped perimeter edge, each of the vanes being generally rectangularly-shaped and laterally-extending downwardly and downstream relative to the path of travel from the associated perimeter edge, whereby air from the fan is directed by each vane at an angle extending in the direction of the path of travel.

BRIEF DESCRIPTION OF THE DRAWINGS

As shown in the drawings wherein like reference numerals designate like or corresponding parts throughout the several views.

DESCRIPTION OF THE PREFERRED EMBODIMENTS

Figure 1:
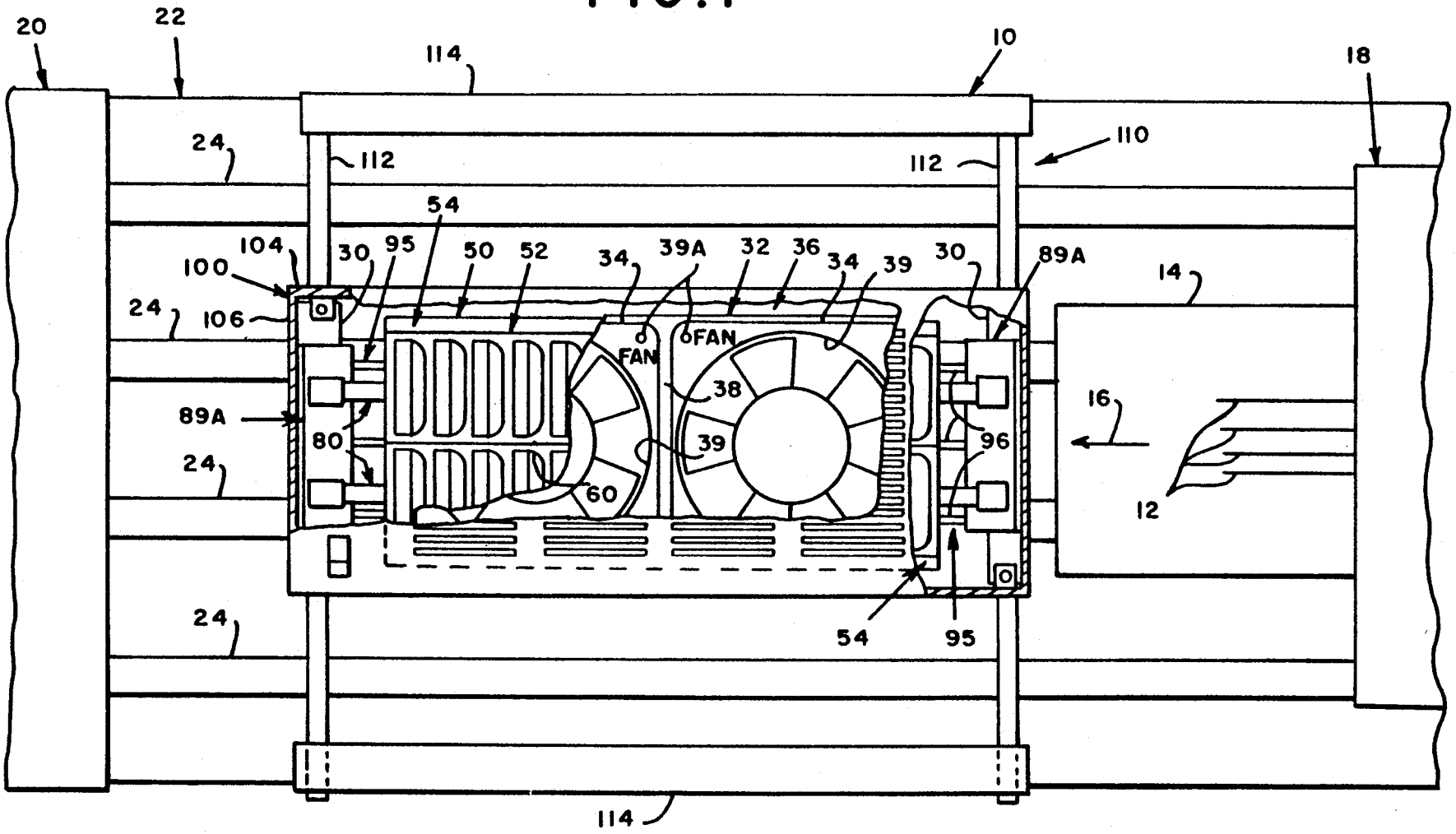
FIG. 1 is a cut-away top plan view of apparatus according to the invention for drying ink on a sheet as the sheet is fed downstream therebeneath, in a predetermined path of travel from ink jet printing structure to sheet stacking structure.

As shown in FIG. 1, the apparatus 10 according to the invention, for drying ink 12 on a sheet 14 fed downstream therebeneath in a predetermined path of travel 16, is shown in a typical environment in which it is used. That is, the ink drying apparatus 10 is located between ink jet printing and sheet stacking structures, respectively designated 18 and 20, for drying printing ink 12 on a sheet 14 fed in a path of travel 16 defined by a conventional conveyor or belt system 22, including a plurality of horizontally-extending belts 24 which carry the sheet 14 downstream beneath the ink drying apparatus 10 from the printing structure 18 to the stacking structure 20. Without departing from the spirit and scope of the invention, a sheet 14 may be a cut sheet, envelope or mailpiece, or the like, and the ink 12 may be printed thereon in alphanumerical or graphic form, or in any combination thereof.

As shown in FIG. 1, the ink drying apparatus 10 includes framework 30 for supporting various components thereof, including structure 32 for blowing air downwardly toward the path of travel 16 of a sheet 14. The air blowing structure 32 includes at least one, and preferably two or more electrically-operable, series connected, A.C. Motor driven, pancake-type, axial fan(s) 34. In addition, for connecting the fan(s) 34 to the framework 30, the air blowing structure 32 preferably includes an air plenum 36 including an elongate generally rectangularly-shaped upper wall 38, having the same number of opening(s) 39 formed therein as the number of fan(s) 34. The fan(s) 34 are conventionally positioned over the opening(s) 39 and suitably fixedly connected to the air plenum's upper wall 38, as by means of a plurality of fasteners 39A. Moreover, the air plenum 36 (FIG. 3) includes a pair of elongate, oppositely-spaced, side walls, 40, and a pair of oppositely-spaced end walls 42 (FIG. 2) extending between the side walls 40. The walls, 40 and 42, respectively depend from the upper wall 38 and form a generally rectangularly-shaped lower outlet opening 44 of the air plenum 36. In addition, each of the plenum end walls 42 (FIG. 2) includes a foot portion 46, which laterally extends therefrom and is conventionally fixedly connected to the framework 30 for supporting the air plenum 36, and thus the connected fan(s) 34, in place. And the fan motor(s) are conventionally adapted to be connected to a local source of supply of A.C. power.

As shown in FIG. 1, the ink drying apparatus 10 additionally includes an elongate, open-ended member 50, which is preferably connected to the framework 30 for location thereof within the air plenum 36, beneath the fan(s) 34. The member 50 includes an elongate upper wall 52, and includes elongate, oppositely disposed, side walls 54 which each depend from the upper wall 52. The upper wall 52 (FIG. 3), and preferably each of the side walls 54, have a light reflecting inner surface 56. And, the opposite ends of each of the side walls 52 include at least one, and preferably a plurality of, tabs 58 extending therefrom which are adapted for receiving conventional fasteners 59 fixedly connecting the member 50 to the opposite end walls 42 of the air plenum 36, and thus to the framework 30, for supporting the member 50 in place within the air plenum 36.

Figure 2:
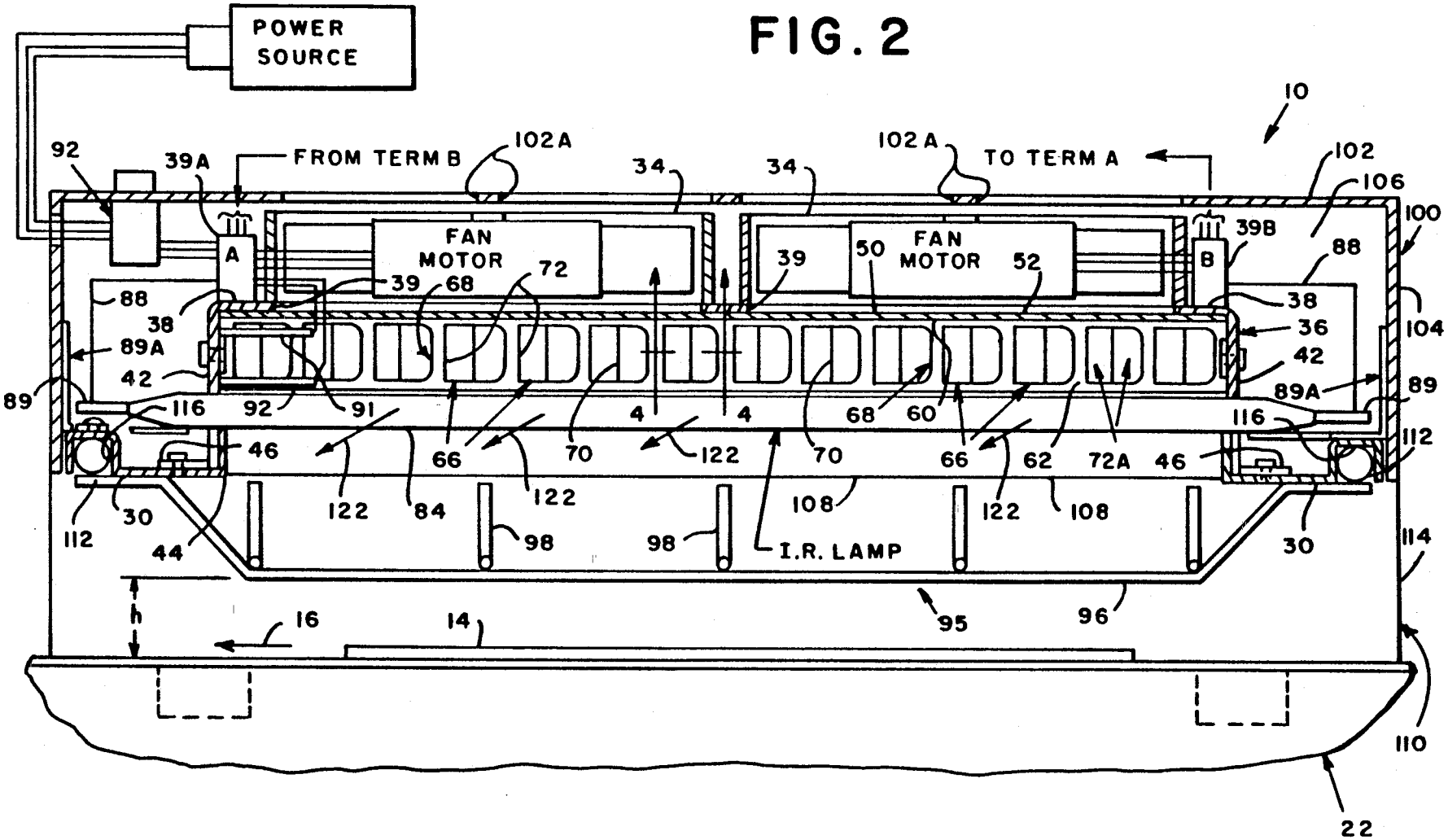
FIG. 2 is a cut-away side elevation of the apparatus of FIG. 1, showing a side view of an infrared light reflecting member according to the invention.
Figure 3:
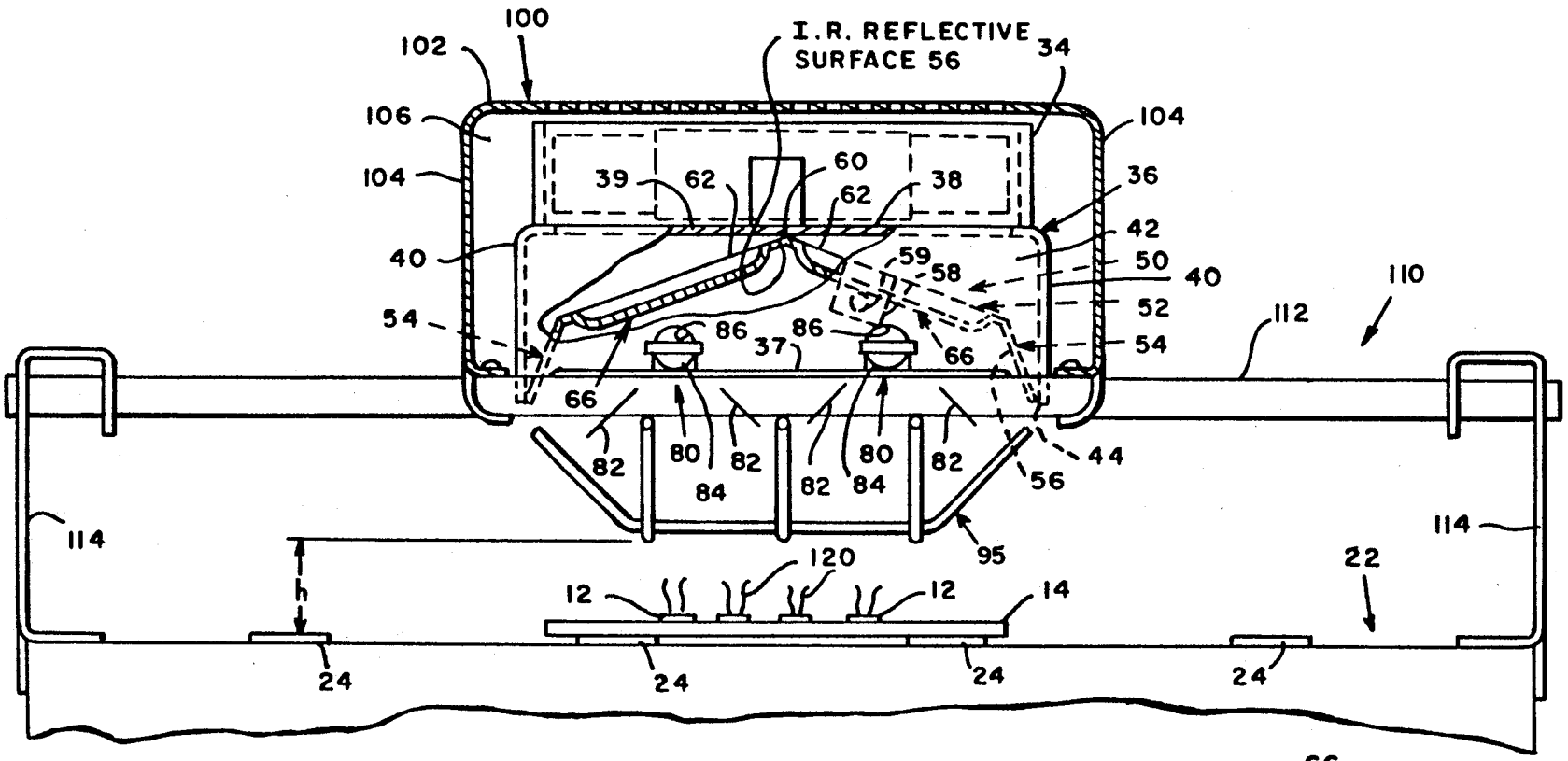
FIG. 3 is an end elevation of the apparatus of FIG. 1.
Figure 4:
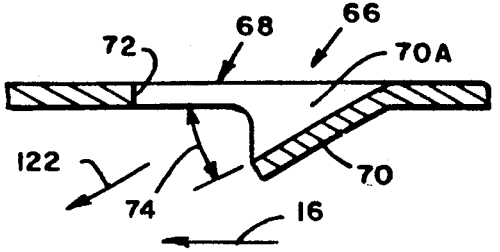
FIG. 4 is a section, taken substantially along the line 4—4 of FIG. 2, showing a scoop-type louver, according to the invention, formed in the infrared light reflecting member of FIG. 2.

As shown in FIGS. 1-3, in order to maximize the light reflecting inner surface 56 of the member 50, the member's upper wall 52 (FIG. 2) preferably includes a longitudinally-extending peak edge 60, which is formed therein substantially midway between the depending side walls 54 for dividing the upper wall 52 into oppositely facing sections 62 thereof which are inclined downwardly from the peak edge 60 to the depending side walls 54. As thus constructed and arranged, the upper wall 52 has a substantially inverted-V-shape in transverse cross-section. In addition, for maximizing the flow of air blown through the member's upper wall 52 by the fan(s) 34, each of the upper wall sections 62 includes a plurality of elongate, parallel-spaced, louvers 66 formed therefrom, which extend transversely of the longitudinally length of the wall section 62. Each of the louvers 66 (FIG. 4) includes an aperture 68 and a scoop-type vane 70. Preferably, each of the apertures 68 has a generally rectangularly-shaped perimeter edge 72. And, although each of the vanes 70 is generally rectangularly-shaped, the opposite, longitudinally-extending, ends 70A curvedly extend upwardly to the associated perimeter edge 72. Thus each of the vanes 70 laterally extends substantially entirely downwardly from the associated perimeter edge 72 and in a direction extending downstream relative to the path of travel 16, for directing air from the air blowing structure 32 at an angle 74 which is inclined toward the direction of the path of travel 16. Preferably, each of the vanes 70 subtends an angle 74 of substantially thirty degrees with respect to the associated aperture perimeter edge 72. Moreover, in the preferred embodiment, one or more or each of the louver perimeter edges 72 defines an aperture area 72A which is greater than the area dimension of the vane 70 associated therewith.

As shown in FIGS. 1 and 3, the ink drying apparatus 10 additionally includes structure 80 for providing infrared light 82. The light providing structure 82 includes at least one, and preferably two, elongate, parallel-spaced, electrically-operable infrared lamp(s) 84. Each of the lamps 84 is loosely physically connected to the framework 30 for location thereof within the light reflecting member 50, preferably by mounting the lamp(s) 84 within oppositely-spaced apertures 86 formed in the air plenum end walls 42 and on oppositely-spaced supports 37 which are fixedly connected to the framework 30. Moreover, the light providing structure 80 includes a plurality of electrical leads 88 (FIG. 2), which extend from the opposite end terminals 89 of each lamp 84 to one or the other of two terminal blocks 39A and 39B (FIG. 2) mounted on the upper wall 38 of the air plenum 36. And, for electrically insulating the terminals 89 from surrounding metal structures, the light providing structure 80 preferably includes a pair of oppositely disposed insulation members 89A which are L-shaped in transverse cross-section and have one leg connected to the framework 30 beneath an associated terminal 89 and the other leg extending upwardly therefrom opposite the free end of the associated terminal 89.

As shown in FIG. 2, for energizing the lamp(s) 84 and fan motors, the terminal blocks 39A and 39B are conventionally electrically connected to one another and adapted to be connected to a local source of supply of power via a conventional on-off switch 90. Preferably, the ink drying apparatus (FIG. 2) additionally includes one or more slow-acting thermal overload switches 91 and, in addition, one or more bimetallic self-resetting fast-acting thermal overload switches 92, which are mounted on the opposite sections 62 of the light reflecting member's upper wall 52, at the downstream end thereof, and conventionally electrically connected in series with one another and with the lamp(s) 84 via the terminal blocks 39A and 39B.

As shown in FIGS. 1-3, the ink drying apparatus 10 further includes structure 95 for guarding against a sheet 14 being fed into engagement with the infrared lamp(s) 84. Preferably, the lamp guarding structure 95 includes a plurality of first, elongate, generally U-shaped, parallel-spaced, metal rods 96. The rods 96 each have their opposite ends conventionally fixedly connected to the framework 30, as by welding, such that they respectively depend from the framework 30 for deflecting a sheet 14 fed thereagainst downwardly toward the path of travel 16. In addition, the lamp guarding structure 95 includes a plurality of second, elongate, generally U-shaped, parallel-spaced metal rods 98 which are conventionally fixedly connected, as by welding, to the first rods 96 at spaced intervals longitudinally of the length thereof for deflecting a sheet 14 fed thereagainst downwardly toward the path of travel 16.

As shown in FIG. 1-3, to protect users against exposure to, or contact with the high temperature components of the ink drying apparatus 10, the apparatus 10 additionally includes an elongate cover 100 for the fan(s) 34, light reflecting members 50 and lamp(s) 84 which are each located within the cover 100. And the cover 100 is suitably connected to the framework 30. The cover 100 preferably includes a substantially rectangularly-shaped upper wall 102, having a plurality of air inlet openings 102A formed therein. In addition, the cover 100 includes oppositely spaced side and end walls, respectively designated 104 and 106, which depend from the upper wall 102. As thus constructed and arranged, the depending walls, 104 and 106, form an elongate, substantially rectangularly-shaped, lower opening 108 of the cover 100 through which light from the lamp(s) and light reflecting member 50, and air from the fan(s) 34, passes downwardly toward the path of travel 16.

As shown in FIGS. 1-3, the ink drying apparatus 10 also includes structure 110 for mounting the framework 30, and thus the cover 100, air blowing structure 32, light reflecting member 50, infrared lamp(s) 84 and lamp guarding structure 95, in overhanging relationship with a conveyor belt system 22. The mounting structure 110 preferably includes a pair of parallel-spaced metal rods 112, and, suitably connected to the opposed ends of the each of the rods 112, a leg member 114 which is conventionally constructed and arranged for seating on a typical commercially available, conveyor system 22, and supporting the framework 30 above the conveyor system 22 such that the height "h" which the lamp guarding structure 95 is disposed above the system's conveyor belt(s) 24 is sufficient to permit the passage therebeneath of conventionally-sized sheets 14. In addition, the mounting structure 110 includes a pair of elongate, parallel-spaced, channels 116 formed by the framework 30. And, the channels 116 are conventionally transversely dimensioned relative to the diameters of the respective rods 112 for receiving the rods 112 therein in a manner such that the framework 30 is slidably movable, longitudinally of the length of the rods 112. As thus constructed and arranged the ink drying apparatus 10 may be mounted in overhanging relationship with the path of travel 16 of respective sheets 14, fed downstream on a conveyor system 22, in a manner such that the framework 30, and thus the respective components, 100, 32, 50, 84 and 95 carried thereby, are slidably movable on the rods 112 in a direction extending transversely of the path of travel 16, to permit selective location thereof above the ink markings on sheets 14 in the path of travel 16. Further, the capture the mounting rods 112 within the channels 116, the upstream and downstream ends of each of the first rods 96 of the lamp guarding structure 95 are configured to extend beneath the mounting rods 112 and in overlapping relationship with the channels 116 to which they are suitably fixedly attached, as by welding.

In operation, as a sheet 14 marked with printing ink 12 is fed downstream in the path of travel 16 from the ink jet printing structure 18 and beneath the ink drying apparatus 10 to the stacking structure 20, infrared radiant energy or light from the infrared lamp(s) 84 heats the ink 12, causing the water content thereof to vaporize. Whereupon, the water vapor 120 is entrained by air 122 from the fan(s) 34, which is directed downstream by the vanes 70 of the light reflecting member 50, and swept thereby downstream from beneath the ink drying apparatus 10. Since the vanes 70 direct the flow of air downstream beneath the ink drying apparatus 10, and thus for the most part in the direction of the path of travel 16, rather than vertically downwardly toward the path of travel, the higher air pressure boundary layer formed thereby immediately above an ink bearing sheet 14 is minimized sufficiently to urge the sheet 14 downwardly and into engagement with the conveyor belts 24 rather than tending to move the sheet 14 relative to the belts 24.

In accordance with the objects of the invention there has been described apparatus for drying ink on a sheet, and, more particularly on a sheet fed downstream in predetermined path of travel therebeneath.

What is claimed is:

1. Apparatus for drying ink on a sheet fed downstream therebeneath in a predetermined path of travel, the apparatus comprising:

(a) framework;

(b) means for blowing air downwardly toward the path of travel of a sheet, the air blowing means including an electrically operable axial fan connected to the framework;

(c) an elongate member connected to the framework for location thereof beneath the fan, the member including an elongate upper wall and elongate oppositely disposed side walls depending from the upper wall, the upper wall having a light reflecting inner surface;

(d) means for providing infrared light, the light providing means including an elongate electrically-operable infrared lamp connected to the framework for location thereof within the member; and (e) the upper wall of the member including a plurality of elongate parallel-spaced louvers formed therefrom and extending transversely of the longitudinal length thereof, each of the louvers including an aperture and vane associated with each other, each of the apertures having a generally rectangularly-shaped perimeter edge, each of the vanes being generally rectangularly-shaped and laterally-extending downwardly and downstream relative to the path of travel from the associated perimeter edge, whereby air from the fan is directed by each vane at an angle extending in the direction of the path of travel.

2. The apparatus according to claim 1, wherein the upper wall includes a longitudinally-extending peak edge formed therein substantially midway between the side walls for dividing the upper wall into oppositely facing sections thereof inclined downwardly from the peak edge to the depending side wall, and each of the upper wall sections including said plurality of louvers.

3. The apparatus according to claim 1, wherein the fan is a first fan, and the air blowing means including a second, electrically operable axial fan connected to the framework.

4. The apparatus according to claim 1, wherein the lamp is a first lamp, the light providing means including a second elongate electrically-operable infrared lamp connected to the framework for location thereof within the member, and the first and second lamps extending parallel to each other.

5. The apparatus according to claim 1, wherein the each of the side walls of the member has a light reflecting inner surface.

6. The apparatus according to claim 1 including means for guarding against a sheet being fed into engagement with the lamp, the guarding means including a plurality of elongate generally U-shaped parallel-spaced rods depending from the framework for deflecting a sheet fed thereagainst downwardly toward the path of travel.

7. The apparatus according to claim 6, wherein the rods are first rods, and the guarding means includes a plurality of parallel-spaced second rods connected to the first rods at spaced intervals longitudinally of the length thereof so as to extend transversely of the path of travel for deflecting a sheet fed thereagainst downwardly toward the path of travel.

8. The apparatus according to claim 6, wherein the guarding means is connected to the framework for location thereof substantially entirely beneath the member.

9. The apparatus according to claim 1 including an elongate cover connected to the framework, the cover including a substantially rectangularly-shaped upper wall having a plurality of openings formed therein, the cover including oppositely spaced side and end walls respectively depending from the upper wall, the fan and member and lamp respectively located within the cover, the depending walls of the cover forming an elongate substantially rectangularly-shaped opening through which light from the lamp and reflected light from the member and air from the fan downwardly pass toward the path of travel.

10. The apparatus according to claim 1, wherein the the perimeter edge of some of the louvers each define an aperture area which is greater than the area of the associated vane.

11. The apparatus according to claim 1 wherein each of the vanes subtends an angle of substantially thirty degrees from the associated perimeter edge.

12. Apparatus for drying ink on a sheet fed downstream therebeneath in a predetermined path of travel, the apparatus comprising:

(a) framework;

(b) means for blowing air downwardly toward the path of travel of a sheet, the air blowing means including an electrically operable axial fan connected to the framework;

(c) an elongate member connected to the framework for location thereof beneath the fan, the member including an elongate upper wall and elongate oppositely disposed side walls depending from the upper wall, the upper wall having a light reflecting inner surface:

(d) means for providing infrared light, the light providing means including an elongate electrically-operable infrared lamp connected to the framework for location thereof within the member;

(e) the upper wall of the member including a plurality of elongate parallel-spaced louvers formed therefrom and extending transversely of the longitudinal length thereof, each of the louvers including an aperture and vane associated with each other, each of the apertures having a generally rectangularly-shaped perimeter edge, each of the vanes being generally rectangularly-shaped and laterally-extending downwardly and downstream relative to the path of travel from the associated perimeter edge, whereby air from the fan is directed by each vane at an angle extending in the direction of the path of travel; and (f) means for mounting the framework in overhanging relationship with the path of travel, the framework and mounting means cooperatively configured to permit the framework to be slidably moved on the mounting means.

13. The apparatus according to claim 1, including a fast-acting bi-metallic thermal overload sensing switch mounted on the upper wall of the light reflecting member at the downstream end thereof, and the switch electrically connected in series with the fan.

14. The apparatus according to claim 1, including a slow-acting thermal overload sensing switch mounted on the upper wall of the light reflecting member at the downstream end thereof, and the switch electrically connected in series with the fan.

15. Apparatus for drying ink on a sheet fed downstream therebeneath in a predetermined path of travel, the apparatus comprising:

(a) framework;

(b) means for blowing air downwardly toward the path of travel of a sheet, the air blowing means including an electrically operable axial fan connected to the framework;

(c) an elongate member connected to the framework for location thereof beneath the fan, the member including an elongate upper wall and elongate oppositely disposed side walls depending from the upper wall, the upper wall having a light reflecting inner surface;

(d) means for providing infrared light, the light providing means including an elongate electrically-operable infrared lamp connected to the framework for location thereof within the member; and (e) the upper wall of the member including a longitudinally-extending peak edge formed therein substantially midway between the side walls for dividing the upper wall into oppositely facing sections thereof inclined downwardly from the peak edge to the depending side walls, each of the upper wall sections including a plurality of elongate parallel-spaced louvers formed therefrom and extending transversely of the longitudinal length of the section, each of the louvers including an aperture and vane associated with each other, each of the apertures having a generally rectangularly-shaped perimeter edge, each of the vanes being generally rectangularly-shaped and laterally-extending downwardly and downstream relative to the path of travel from the associated perimeter edge, whereby air from the fan is directed by each vane at an angle extending in the direction of the path of travel.

16. The apparatus according to claim 15, wherein the fan is a first fan, and the air blowing means including a second, electrically operable axial fan connected to the framework.

17. The apparatus according to claim 15, wherein the lamp is a first lamp, the light providing means including a second elongate electrically-operable infrared lamp connected to the framework for location thereof within the member, and the first and second lamps extending parallel to each other.

18. The apparatus according to claim 15, wherein the each of the side walls of the member has a light reflecting inner surface.

19. The apparatus according to claim 15 including means for guarding against a sheet being fed into engagement with the lamp, the guarding means including a plurality of elongate generally U-shaped parallel-spaced rods depending from the framework for defecting a sheet fed thereagainst downwardly toward the path of travel.

20. The apparatus according to claim 19, wherein the rods are first rods, and the guarding means includes a plurality of parallel-spaced second rods connected to the first rods at spaced intervals longitudinally of the length thereof so as to extend transversely of the path of travel for deflecting a sheet fed thereagainst downwardly toward the path of travel.

21. The apparatus according to claim 19, wherein the guarding means is connected to the framework for location thereof substantially entirely beneath the member.

22. The apparatus according to claim 15 including an elongate cover connected to the framework, the cover including a substantially rectangularly-shaped upper wall having a plurality of openings formed therein, the cover including oppositely spaced side and end walls respectively depending from the upper wall, the fan and member and lamp respectively located within the cover, the depending walls of the cover forming an elongate substantially rectangularly-shaped opening through which light from the lamp and reflected light from the member and air from the fan downwardly pass toward the path of travel.

23. The apparatus according to claim 15, wherein the the perimeter edge of some of the louvers each define an aperture area which is greater than the area of the associated vane.

24. The apparatus according to claim 15 wherein each of the vanes subtends an angle of substantially thirty degrees from the associated perimeter edge.

25. Apparatus for drying ink on a sheet fed downstream therebeneath in a predetermined path of travel, the apparatus comprising:

(a) framework;

(b) means for blowing air downwardly toward the path of travel of a sheet, the air blowing means including an electrically operable axial fan connected to the framework;

(c) an elongate member connected to the framework for location thereof beneath the fan, the member including an elongate upper wall and elongate oppositely disposed side walls depending from the upper wall, the upper wall having a light reflecting inner surface;

(d) means for providing infrared light, the light providing means including an elongate electrically-operable infrared lamp connected to the framework for location thereof with the member;

(e) the upper wall of the member including a longitudinally-extending peak edge formed therein substantially midway between the side walls for dividing the upper wall into oppositely facing sections thereof inclined downwardly from the peak edge to the depending side walls, each of the upper wall sections including a plurality of elongate parallel-spaced louvers formed therefrom and extending transversely of the longitudinal length of the section, each of the louvers including an aperture and vane associated with each other, each of the apertures having a generally rectangularly-shaped perimeter edge, each of the vanes being generally rectangularly-shaped and laterally-extending downwardly and downstream relative to the path of travel from the associated perimeter edge, whereby air from the fan is directed by each vane at an angle extending in the direction of the path of travel; and (f) means for mounting the framework in overhanging relationship with the path of travel, the framework and mounting means cooperatively configured to permit the framework to be slidably moved on the mounting means.

* * * * *